US006514581B1

(12) United States Patent
Gregory

(10) Patent No.: US 6,514,581 B1
(45) Date of Patent: Feb. 4, 2003

(54) POP-UP ARTIFICIAL CHRISTMAS TREE

(76) Inventor: Cheryl A. Gregory, 303-C Imperial Beach Blvd., Imperial Beach, CA (US) 91932

( * ) Notice: Subject to any disclaimer, the term of this patent is extended or adjusted under 35 U.S.C. 154(b) by 57 days.

(21) Appl. No.: 09/780,007

(22) Filed: Feb. 9, 2001

(51) Int. Cl.[7] ..... A01N 3/00

(52) U.S. Cl. ..... 428/20; 428/18; 428/19; D11/118

(58) Field of Search ..... 428/7, 9, 12, 18, 428/19, 20; 211/196, 205; 362/123, 568, 581; D11/118, 121, 157

(56) References Cited

U.S. PATENT DOCUMENTS 4,130,678 A 12/1978 Higgins
4,140,823 A * 2/1979 Weskamp ..... 428/9
4,374,877 A 2/1983 Cole
4,659,597 A 4/1987 Lau
4,847,123 A 7/1989 Armstead et al.
D406,077 S 2/1999 Cox et al.
5,878,945 A 3/1999 Weder
5,893,547 A * 4/1999 Cohen, Jr. ..... 248/521
6,056,427 A * 5/2000 Kao ..... 362/581

* cited by examiner

*Primary Examiner*—Deborah Jones
*Assistant Examiner*—Abraham Bahta

(57) ABSTRACT

A pop-up artificial Christmas tree, for making it much easier for the user to set up and take an artificial Christmas tree. The pop-up artificial Christmas tree includes a base member assembly including a weighted base member; and also includes a tree trunk assembly including a hollow tree trunk member having a bottom end which is removably mounted to the base member, and also including an elongate support member being movably disposed and upwardly biased in the hollow tree trunk member with the hollow tree trunk member having a plurality of holes spaced along and disposed through a side wall thereof; and further includes a branch assembly having a plurality of branch members each being pivotally mounted to the elongate support member and being extended through a respective hole in said hollow tree trunk member; and also includes a light-emitting assembly having a plurality of light-emitting members securely attached to the branch members.

20 Claims, 5 Drawing Sheets

POP-UP ARTIFICIAL CHRISTMAS TREE

BACKGROUND OF THE INVENTION

1. Field of the Invention

The present invention relates to a collapsible artificial Christmas tree and more particularly pertains to, a new pop-up artificial Christmas tree for making it much easier for the user to set up and take an artificial Christmas tree.

2. Description of the Prior Art

The use of a collapsible artificial Christmas tree is known in the prior art. More specifically, a collapsible artificial Christmas: tree heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4;847,123; 4,374,877; 4,659,597; 4,130,678; 5,878,945; and U.S. Pat. No. Des. 406,077.

While these devices fulfill their respective, particular objectives and requirements, the aforementioned patents do not disclose a new pop-up artificial Christmas tree. The inventive device includes a base member assembly including a weighted base member; and also includes a tree trunk assembly including a hollow tree trunk member having a bottom end which is removably mounted to the base member, and also including an elongate support member being movably disposed and upwardly biased in the hollow tree trunk member with the hollow tree trunk member having a plurality of holes spaced along and disposed through a side wall thereof; and further includes a branch assembly having a plurality of branch members each being pivotally mounted to the elongate support member and being extended through a respective hole in said hollow tree trunk member; and also includes a light-emitting assembly having a plurality of light-emitting members securely attached to the branch members.

In these respects, the pop-up artificial Christmas tree according to the present invention substantially departs from the conventional concepts and designs of the prior art, and in so doing provides an apparatus primarily developed for the purpose of making it much easier for the user to set up and take an artificial Christmas tree.

SUMMARY OF THE INVENTION

In view of the foregoing disadvantages inherent in the known types of collapsible artificial Christmas tree now present in the prior art, the present invention provides a new pop-up artificial Christmas tree construction wherein the same can be utilized for making it much easier for the user to set up and take an artificial Christmas tree.

The general purpose of the present invention, which will be described subsequently in greater detail, is to provide a new pop-up artificial Christmas tree which has many of the advantages of the collapsible artificial Christmas tree mentioned heretofore and many novel features that result in a new pop-up artificial Christmas tree which is not anticipated, rendered obvious, suggested, or even implied by any of the prior art collapsible artificial Christmas tree, either alone or in any combination thereof.

To attain this, the present invention generally comprises a base member assembly including a weighted base member; and also includes a tree trunk assembly including a hollow tree trunk member having a bottom end which is removably mounted to the base member, and also including an elongate support member being movably disposed and upwardly biased in the hollow tree trunk member with the hollow tree trunk member having a plurality of holes spaced along and disposed through aside wall thereof; and further includes a branch assembly having a plurality of branch members each being pivotally mounted to the elongate support member and being extended through a respective hole in said hollow tree trunk member; and also includes a light-emitting assembly having a plurality of light-emitting members securely attached to the branch members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pop-up artificial Christmas tree which has many of the advantages of the collapsible artificial Christmas tree mentioned heretofore and many novel features that result in a new pop-up artificial Christmas tree which is not anticipated, rendered obvious, suggested, or even implied by any of the prior art collapsible artificial Christmas tree, either alone or in any combination thereof.

It is another object of the present invention to provide a new pop-up artificial Christmas tree which may be easily and efficiently manufactured and marketed.

It is a further object of the present invention to provide a new pop-up artificial Christmas tree which is of a durable and reliable construction.

An even further object of the present invention is to provide a new pop-up artificial Christmas tree which is susceptible of a low cost of manufacture with regard to both materials and labor, and which accordingly is then susceptible of low prices of sale to the consuming public, thereby making such pop-up artificial Christmas tree economically available to the buying public.

Still yet another object of the present invention is to provide a new pop-up artificial Christmas tree which provides in the apparatuses and methods of the prior art some of the advantages thereof, while simultaneously overcoming some of the disadvantages normally associated therewith.

Still another object of the present invention is to provide a new pop-up artificial Christmas tree for making it much easier for the user to set up and take an artificial Christmas tree.

Yet another object of the present invention is to provide a new pop-up artificial Christmas tree which includes a base member assembly including a weighted base member; and also includes a tree trunk assembly including a hollow tree trunk member having a bottom end which is removably mounted to the base member, and also including an elongate support member being movably disposed and upwardly biased in the hollow tree trunk member with the hollow tree trunk member having a plurality of holes spaced along and disposed through a side wall thereof; and further includes a branch assembly having a plurality of branch members each being pivotally mounted to the elongate support member and being extended through a respective hole in said hollow tree trunk member; and also includes a light-emitting assembly having a plurality of light-emitting members securely attached to the branch members.

Still yet another object of the present invention is to provide a new pop-up artificial Christmas tree that eliminates the user having to attach each branch member individually to the tree trunk member.

Even still another object of the present invention is to provide a new pop-up artificial Christmas tree that is easy and convenient to use and store when not being used.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
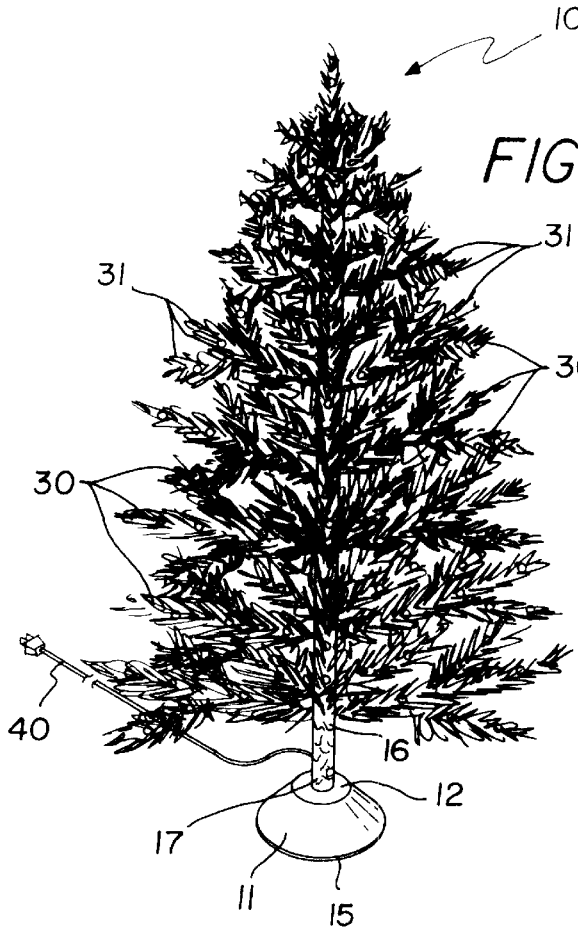
FIG. 1 is a perspective view of a new pop-up artificial Christmas tree according to the present invention shown in use.
Figure 2:
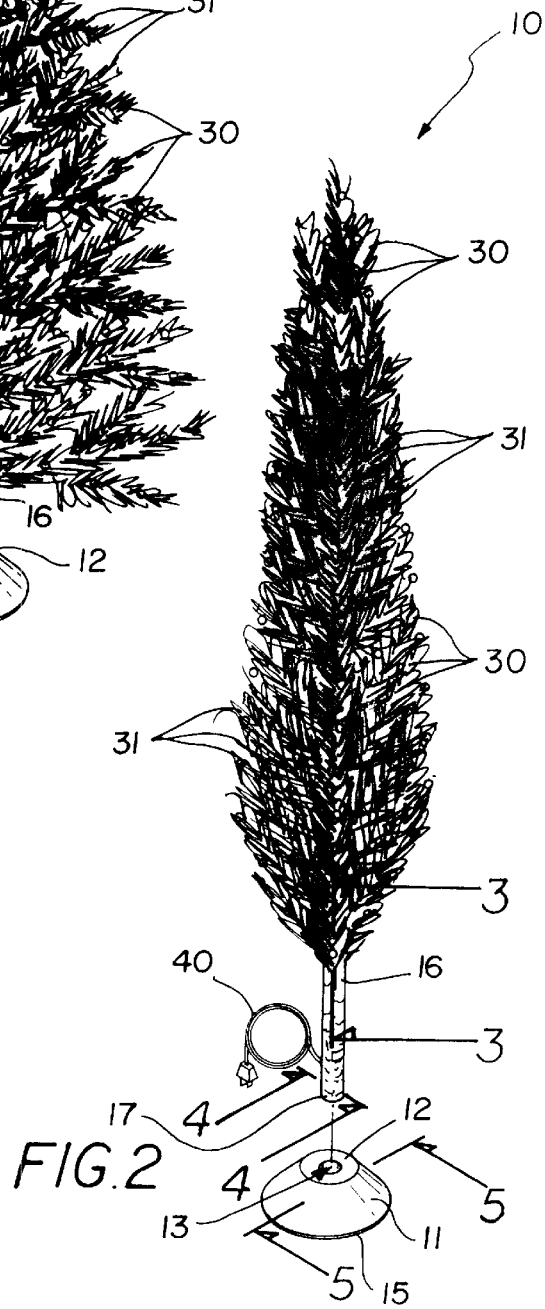
FIG. 2 is an exploded perspective view of the present invention with the branch member being folded against the tree trunk member.
Figure 3:
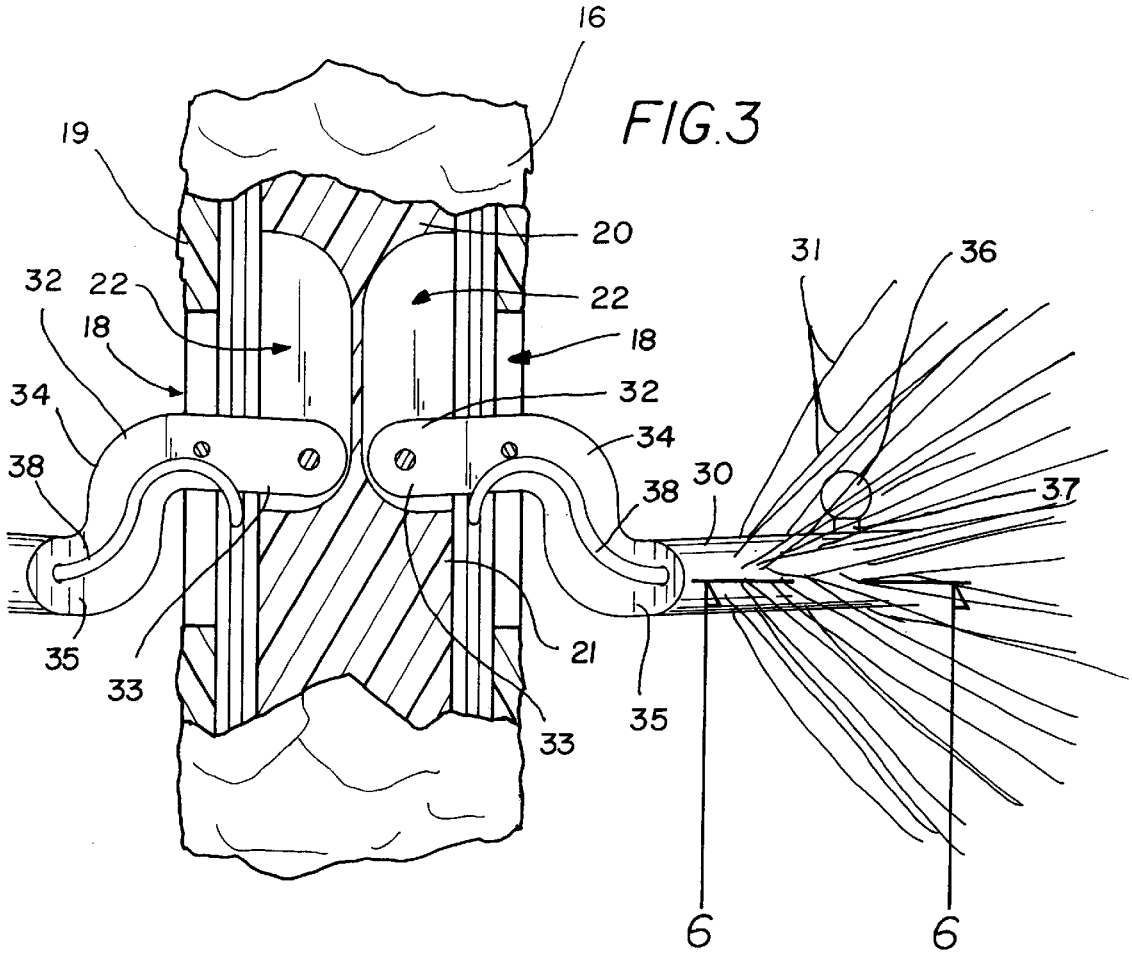
FIG. 3 is a cross-sectional view of a middle portion of the tree trunk member of the present invention.
Figure 4:
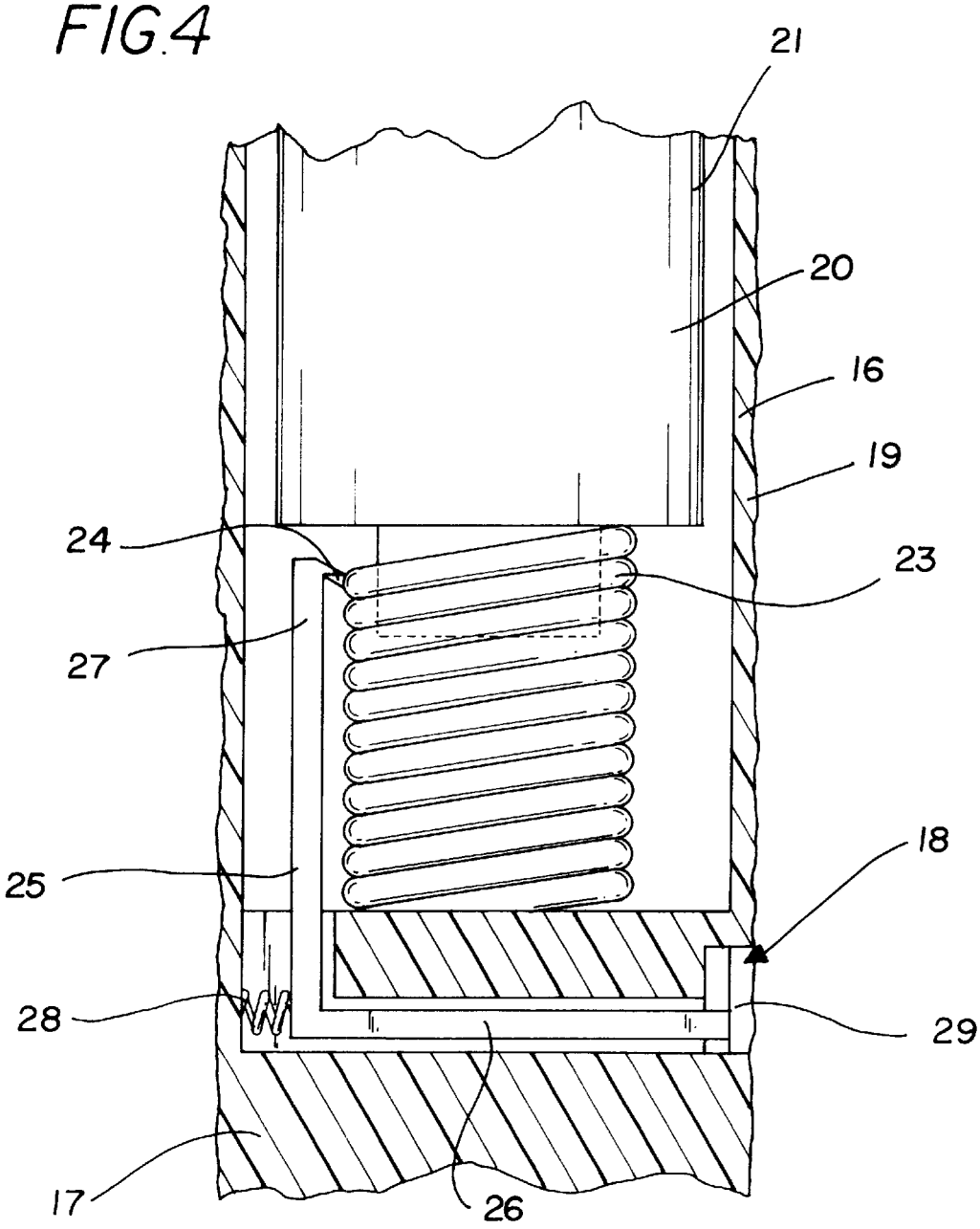
FIG. 4 is a cross-sectional view of a base portion of the tree trunk member of the present invention.
Figure 5:
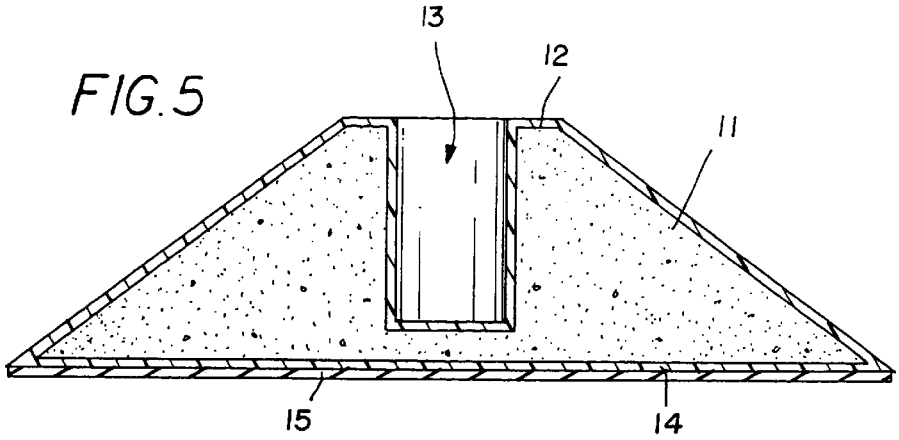
FIG. 5 is a cross-sectional view of the base assembly of the present invention
Figure 6:
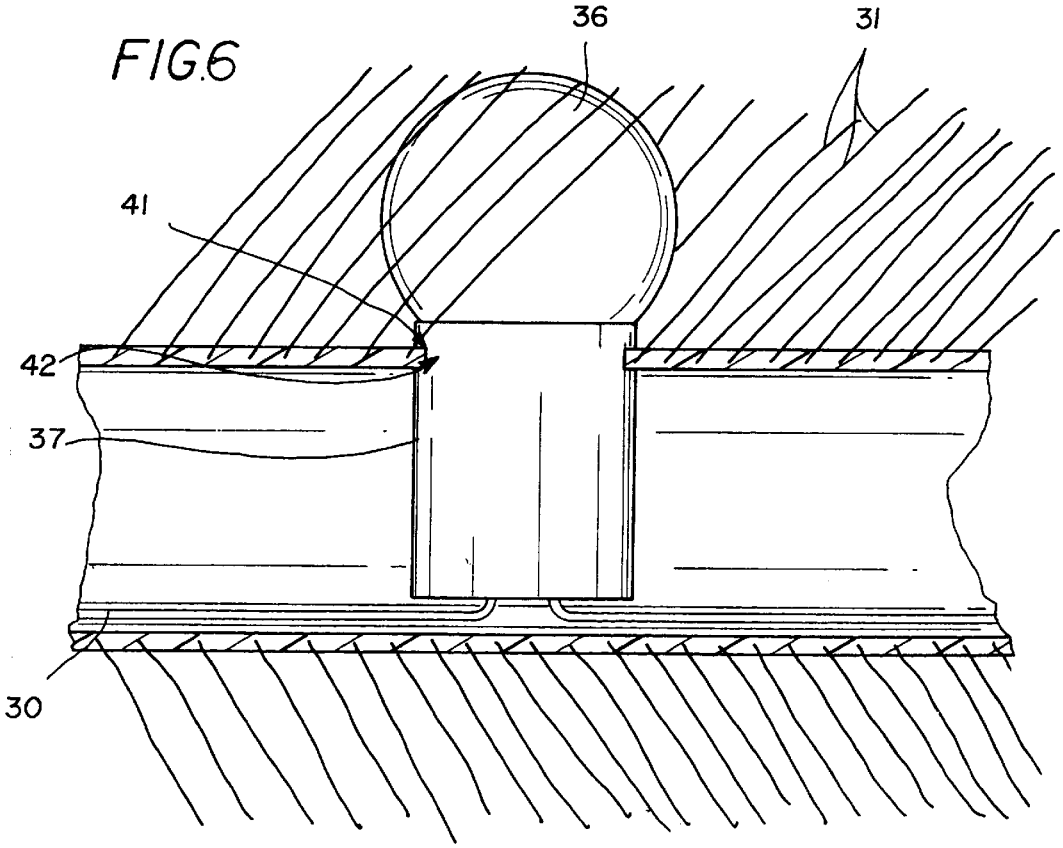
FIG. 6 is a cross-sectional view of one of the branch members of the present invention.
Figure 7:
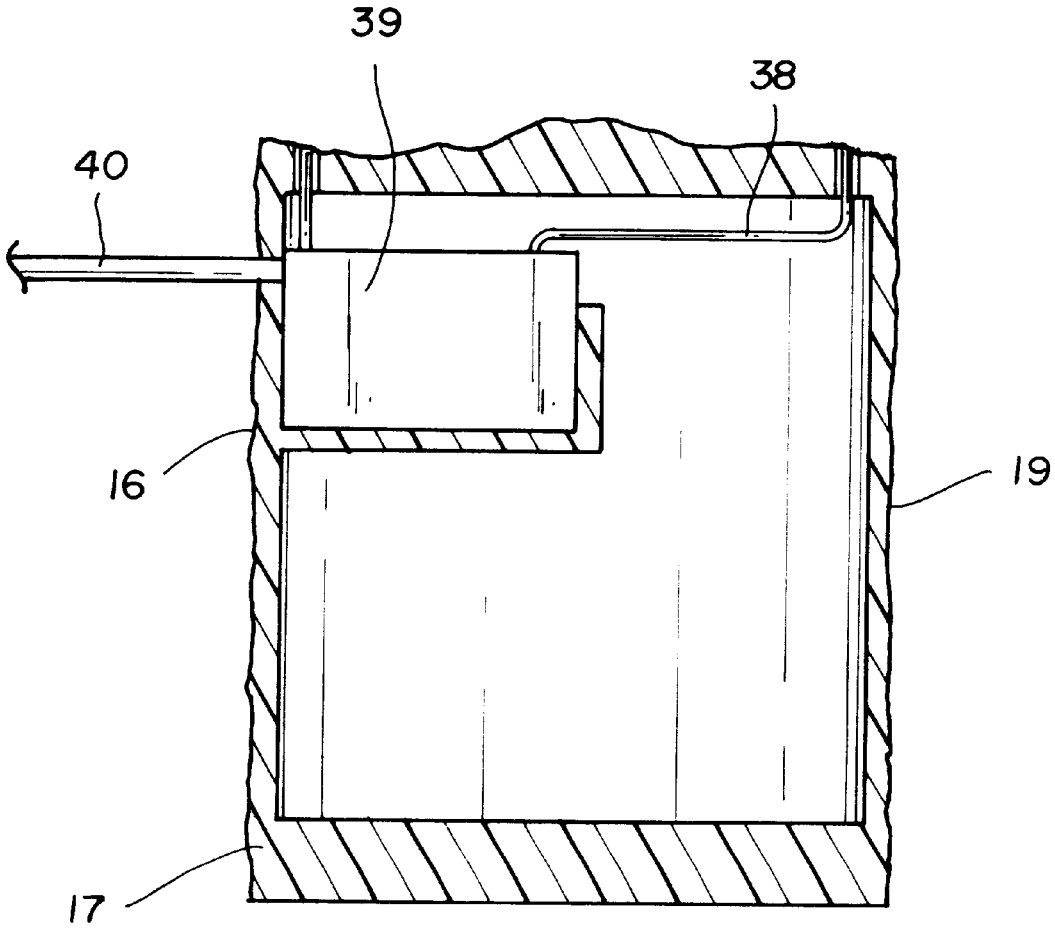
FIG. 7 is another cross-sectional view of a base portion of the tree trunk member of the present invention.

With reference now to the drawings, and in particular to FIGS. 1 through 7 thereof, a new pop-up artificial Christmas tree embodying the principles and concepts of the present invention and generally designated by the reference numeral 10 will be described.

As best illustrated in FIGS. 1 through 7, the pop-up artificial Christmas tree 10 generally comprises a base member assembly including a weighted base member 11 having a top end 12, a bottom surface 14, and a bore 13 extending therein through the top end 12. The base member assembly also includes a rubberized member 15 securely and conventionally attached to the bottom surface 14 of the weighted base member 11.

A tree trunk assembly includes a hollow tree trunk member 16 having a bottom end 17 which is removably mounted in the bore 13 of the base member 11, and also includes an elongate support member 20 being movably disposed and upwardly biased in the hollow tree trunk member 16. The hollow tree trunk member 16 has a plurality of holes 18 spaced along and disposed along and through a side wall 19 thereof. The tree trunk assembly also includes a spring member 23 conventionally disposed in the hollow tree trunk member 16 and upon the bottom end 17 thereof for biasing the elongate support member 20 upwardly in the hollow tree trunk member 16. The tree trunk assembly further includes a catch member 24 securely and conventionally attached to and extending from the spring member 23, and also includes a latch member 25 movably disposed in the hollow tree trunk member 16 and being biasedly and releaseably engaged to the catch member 24, and further includes a spring 28 being disposed in the hollow tree trunk member 16 and being engaged to the latch member 25 for biasing the latch member 25 into engagement with the catch member 24, and also includes a latch release member 29 movably and conventionally disposed in one of the holes 18 in the hollow tree trunk member 16 and being securely and conventionally attached to the latch member 25. The latch member 25 includes a first portion 26 having an end to which the latch release member 28 is attached, and also includes a second portion 27 having a flange 43 attached at an end thereof and being biasedly engageable to the catch member 24 and which is angled relative to the first portion 26 for holding the spring member 23 in a compressed position. The elongate support member 20 includes a plurality of slots 22 being spaced apart and being disposed in and along a side wall 21 thereof.

A branch assembly has a plurality of branch members 30 each being pivotally mounted to the elongate support member 20 and being extended through a respective hole 18 in the hollow tree trunk member 16 and having a plurality of needle-like members 31 extending therefrom. The branch assembly also includes a plurality of bracket members 32 being pivotally and conventionally mounted in the slots 22 of the elongate support member 20 and being conventionally attached to the branch members 30. Each of the bracket members 32 pivotally extends through a respective hole 18 in the hollow tree trunk member 16 and includes an elongate first end portion, 33 having an end which its pivotally attached in a respective slot 22 of the elongate support member 20, and also includes an intermediate portion 34 which integrally attached to the first end portion 33 and which is angled relative to the first end portion 33, and further includes an elongate second end portion 35 which is integrally attached to and angled relative to the intermediate portion 34 and which is disposed essentially parallel to the first end portion 33 and which has an end which is securely and conventionally attached to a respective the branch member 30.

A light-emitting assembly has a plurality of light-emitting members 36 securely and conventionally attached to the branch members 30. The light-emitting assembly also includes wires 38 connected to the light-emitting members 36 and extending through the branch members 30 and through the hollow tree trunk member 16, and further includes a power converter unit 39 securely and conventionally disposed in the hollow tree trunk member 16 and being connected to the wires 38, and also includes a power cord 40 being conventionally connected to the power converter unit 39. Each of the branch members 30 has a hollow interior and includes a plurality of openings 42 being spaced apart and being disposed in and along a side wall thereof. The light-emitting assembly includes a plurality of light-emitting support members 37 being connected to the wires 38 and being adapted to conventionally support the light-emitting members 36. Each of the light-emitting support members 37 has a side wall and a circumferentially-extending groove 41 disposed in the side wall with the circumferentially-extending groove 41 of each of the light-emitting support members 37 being adapted to receive an edge forming a respective opening 42 in a respective branch member 30 to securely retain and support the light-emitting support member 37 to the branch member 30.

In use, the user can quickly set up and take down the artificial Christmas tree 10 with little or no effort with the user having to place the bottom end 17 of the hollow tree trunk member 16 in the bore 13 of the weighted base member 11 and then pressing the latch release member 29 to release the latch member 25 and allow the spring member 23 to urge the elongate support member 20 upwardly inside the hollow tree trunk member 16 with the branch member 30 automatically pivoting outwardly through the holes 18 in the hollow tree trunk member 16. The light-emitting members 36 are turned on by the user plugging the power cord 40 into a suitable electrical outlet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pop-up artificial Christmas tree comprising:

a base member assembly including a weighted base member;

a tree trunk assembly including a hollow tree trunk member having a bottom end which is removably mounted to said base member, and also including an elongate support member being movably disposed and upwardly biased in said hollow tree trunk member, said hollow tree trunk member having a plurality of holes spaced along and disposed through a side wall thereof;

a branch assembly having a plurality of branch members each being pivotally mounted to said elongate support member;

wherein said tree trunk assembly also includes a spring member disposed in said hollow tree trunk member and upon said bottom end thereof for biasing said elongate support member upwardly in said hollow tree trunk member; and wherein said tree trunk assembly further includes a catch member securely attached to and extending from said spring member, and also includes a latch member movably disposed in said hollow tree trunk member and being biasedly and releaseably engaged to said catch member, and further includes a spring being disposed in said hollow tree trunk member and being engaged to said latch member for biasing said latch member into engagement with said catch member, and also includes a latch release member movably disposed in one of said holes in said hollow tree trunk member and being securely attached to said latch member.

2. A pop-up artificial Christmas tree as described in claim 1, wherein said weighted base member has a top end, a bottom surface, and a bore extending therein through said top end and being adapted to receive and support said bottom end of said hollow tree trunk member.

3. A pop-up artificial Christmas tree as described in claim 2, wherein said base member assembly also includes a rubberized member securely attached to said bottom surface of said weighted base member.

4. A pop-up artificial Christmas tree as described in claim 1, wherein said latch member includes a first portion having an end to which said latch release member is attached, and also includes a second portion having a flange being disposed at an end thereof and being biasedly engageable to said catch member, and which is angled relative to said first portion for holding said spring member in a compressed position.

5. A pop-up artificial Christmas tree as described in claim 4, wherein said elongate support member includes a plurality of slots being spaced apart and being disposed in a side wall thereof.

6. A pop-up artificial Christmas tree as described in claim 5, wherein each of said branch members extends through a respective said hole in said hollow tree trunk member and having a plurality of needle-like member extending therefrom; and wherein said branch assembly also includes a plurality of bracket members being pivotally mounted in said slots of said elongate support member and being attached to said branch members.

7. A pop-up artificial Christmas tree as described in claim 6, wherein each of said bracket members pivotally extends through a respective said hole in said hollow tree trunk member and includes an elongate first end portion having an end which is pivotally attached in a respective slot of said elongate support member, and also includes an intermediate portion which integrally attached to said first end portion and which is angled relative to said first end portion, and further includes an elongate second end portion which is integrally attached to and angled relative to said intermediate portion and which is disposed essentially parallel to said first end portion and which has an end which is securely attached to a respective said branch member.

8. A pop-up artificial Christmas tree as described in claim 7, further comprising a light-emitting assembly having a plurality of light-emitting members securely attached to said branch members; and wherein said light-emitting assembly also includes wires connected to said light-emitting members and extending through said branch members and through said hollow tree trunk member, and further includes a power converter unit securely disposed in said hollow tree trunk member and being connected to said wires, and also includes a power cord being connected to said power converter unit.

9. A pop-up artificial Christmas tree as described in claim 8, wherein each of said branch members has a hollow interior and includes a plurality of openings being spaced apart and being disposed in and along a side wall thereof.

10. A pop-up artificial Christmas tree as described in claim 9, wherein said light-emitting assembly includes a plurality of light-emitting support members being connected to said wires and being adapted to support said light-emitting members, each of said light-emitting support members having a side wall and a circumferentially-extending groove disposed in said side wall.

11. A pop-up artificial Christmas tree as described in claim 10, wherein said circumferentially-extending groove of each of said light-emitting support members is adapted to receive an edge forming a respective said opening in a respective said branch member to securely retain and support said light-emitting support member to said branch member.

12. A pop-up artificial Christmas tree comprising:

a base member assembly including a weighted base member;

a tree trunk assembly including a hollow tree trunk member having a bottom end which is removably mounted to said base member, and also including an elongate support member being movably disposed and upwardly biased in said hollow tree trunk member, said hollow tree trunk member having a plurality of holes spaced along and disposed through a side wall thereof;

a branch assembly having a plurality of branch members each being pivotally mounted to said elongate support member and being extended through a respective said hole in said hollow tree trunk member and having a plurality of needle-like member extending therefrom;

a light-emitting assembly having a plurality of light-emitting members securely attached to said branch members;

wherein said weighted base member has a top end, a bottom surface, and a bore extending therein through said top end and being adapted to receive and support said bottom end of said hollow tree trunk member;

wherein said base member assembly also includes a rubberized member securely attached to said bottom surface of said weighted base member;

wherein said tree trunk assembly also includes a spring member disposed in said hollow tree trunk member and upon said bottom end thereof for biasing said elongate support member upwardly in said hollow tree trunk member; and wherein said tree trunk assembly further includes a catch member securely attached to and extending from said spring member, and also includes a latch member movably disposed in said hollow tree trunk member and being biasedly and releaseably engaged to said catch member, and further includes a spring being disposed in said hollow tree trunk member and being engaged to said latch member for biasing said latch member into engagement with said catch member, and also includes a latch release member movably disposed in one of said holes in said hollow tree trunk member and being securely attached to said latch member.

13. A pop-up artificial Christmas tree as described in claim 12, wherein said latch member includes a first portion having an end to which said latch release member is attached, and also includes a second portion having a flange being disposed at an end thereof and being biasedly engageable to said catch member, and which is angled relative to said first portion for holding said spring member in a compressed position.

14. A pop-up artificial Christmas tree as described in claim 13, wherein said elongate support member includes a plurality of slots being spaced apart and being disposed in a side wall thereof.

15. A pop-up artificial Christmas tree as described in claim 14, wherein said branch assembly also includes a plurality of bracket members being pivotally mounted in said slots of said elongate support member and being attached to said branch members.

16. A pop-up artificial Christmas tree as described in claim 15, wherein each of said bracket members pivotally extends through a respective said hole in said hollow tree trunk member and includes an elongate first end portion having an end which is pivotally attached in a respective slot of said elongate support member, and also includes an intermediate portion which integrally attached to said first end portion and which is angled relative to said first end portion, and further includes an elongate second end portion which is integrally attached to and angled relative to said intermediate portion and which is disposed essentially parallel to said first end portion and which has an end which is securely attached to a respective said branch member.

17. A pop-up artificial Christmas tree as described in claim 16, wherein said light-emitting assembly also includes wires connected to said light-emitting members and extending through said branch members and through said hollow tree trunk member, and further includes a power converter unit securely disposed in said hollow tree trunk member and being connected to said wires, and also includes a power cord being connected to said power converter unit.

18. A pop-up artificial Christmas tree as described in claim 17, wherein each of said branch members has a hollow interior and includes a plurality of openings being spaced apart and being disposed in and along a side wall thereof.

19. A pop-up artificial Christmas tree as described in claim 18, wherein said light-emitting assembly includes a plurality of light-emitting support members being connected to said wires and being adapted to support said light-emitting members, each of said light-emitting support members having a side wall and a circumferentially-extending groove disposed in said side wall.

20. A pop-up artificial Christmas tree as described in claim 19, wherein said circumferentially-extending groove of each of said light-emitting support members is adapted to receive an edge forming a respective said opening in a respective said branch member to securely retain and support said light-emitting support member to said branch member.

* * * * *